US009561940B2

(12) United States Patent
Kasai

(10) Patent No.: US 9,561,940 B2
(45) Date of Patent: Feb. 7, 2017

(54) HOIST WITH BUILT-IN LOAD SENSITIVE AUTOMATIC SPEED CHANGE DEVICE

(75) Inventor: Takayuki Kasai, Yamanashi (JP)

(73) Assignee: KITO CORPORATION, Yamanashi (JP)

( * ) Notice: Subject to any disclaimer, the term of this patent is extended or adjusted under 35 U.S.C. 154(b) by 516 days.

(21) Appl. No.: 13/821,342

(22) PCT Filed: Sep. 6, 2011

(86) PCT No.: PCT/JP2011/070244
§ 371 (c)(1),
(2), (4) Date: Apr. 26, 2013

(87) PCT Pub. No.: WO2012/033087
PCT Pub. Date: Mar. 15, 2012

(65) Prior Publication Data

US 2013/0200319 A1 Aug. 8, 2013

(30) Foreign Application Priority Data

Sep. 10, 2010 (JP) ..... 2010-202756

(51) Int. Cl.
*B66D 1/22* (2006.01)
*B66D 3/16* (2006.01)

(52) U.S. Cl.
CPC ..... *B66D 1/225* (2013.01); *B66D 3/16* (2013.01); *B66D 1/22* (2013.01)

(58) Field of Classification Search
CPC ..... B66D 1/225; B66D 1/22
(Continued)

(56) References Cited

U.S. PATENT DOCUMENTS 2,403,095 A * 7/1946 Lear ..... 212/87
2,500,326 A * 3/1950 Shaff ..... 254/344
(Continued)

FOREIGN PATENT DOCUMENTS

| | | |
|---|---|---|
| JP | 2010-116957 | 5/2010 |
| JP | 2011-106666 | 6/2011 |
| JP | 2012-52572 | 3/2012 |

OTHER PUBLICATIONS

International Search Report issued Nov. 15, 2011 in corresponding International Application No. PCT/JP2011/070244.

*Primary Examiner* — Emmanuel M Marcelo
*Assistant Examiner* — Justin Stefanon
(74) *Attorney, Agent, or Firm* — Wenderoth, Lind & Ponack, L.L.P.

(57) ABSTRACT

A hoist with built-in load sensitive automatic speed change device includes: a high-torque input member coupled to a hand wheel, a magnetic clutch coupled via a speed-increasing mechanism and configured to transmit a low load, and an output transmitting means configured to transmit a rotational operating force of the hand wheel to mechanical brakes via the high-torque input member or magnetic clutch, wherein the hand wheel is axially supported by a drive member coupled to the output transmitting means of the mechanical brakes and rotated thereby, the magnetic clutch is arranged between the speed-increasing mechanism and the hand wheel, the hand wheel and the speed-increasing mechanism are coupled by a hollow input member provided so as to cover the outer periphery of the magnetic clutch, the output transmitting means is fitted onto a boss portion of the drive member so as to allow torque transmission to the boss portion.

3 Claims, 8 Drawing Sheets

(58) Field of Classification Search
USPC ..... 254/344
See application file for complete search history.

(56) References Cited

U.S. PATENT DOCUMENTS

| | | | | |
|---|---|---|---|---|
| 2,875,876 | A * | 3/1959 | Rudisch | F16D 27/09 192/69.8 |
| 3,460,807 | A * | 8/1969 | Pankov et al. | 254/297 |
| 3,797,325 | A * | 3/1974 | Christison | 74/339 |
| 3,799,005 | A * | 3/1974 | Koehler | 475/12 |
| 4,453,430 | A * | 6/1984 | Sell | 475/116 |
| 5,119,918 | A * | 6/1992 | Pardee | F16D 67/06 192/12 D |
| 6,921,250 | B2 * | 7/2005 | Boffelli | F01P 7/06 416/155 |
| 7,891,641 | B1 * | 2/2011 | Miller | 254/346 |
| 2002/0171072 | A1 * | 11/2002 | Tso-Kuo | 254/345 |
| 2003/0151037 | A1 * | 8/2003 | O'Fallon | 254/344 |
| 2007/0221898 | A1 * | 9/2007 | Giacomini et al. | 254/323 |

* cited by examiner (b)

(a)

(b)

(a)

HOIST WITH BUILT-IN LOAD SENSITIVE AUTOMATIC SPEED CHANGE DEVICE

TECHNICAL FIELD

The present invention relates to a hoist with built-in load sensitive automatic speed change device and, more specifically, to a hoist with built-in load sensitive automatic speed changer in which the offset amount between a hand wheel and a load chain is small.

BACKGROUND ART

In the related art, an automatic speed changer of a hoist including two clutch mechanisms and enabling high-speed hoisting when no load is applied is developed. However, since a contact-type switching system in which a transmission plate is mechanically slid is employed, there is a problem that an internal resistance at the time of switching is large, and hence the operability is not good. Therefore, a hoist with built-in load sensitive automatic speed change device in which an operator needs not to perform a cumbersome gear-shifting operation every time when the state of a load changes, and when hoisting a predetermined load or larger, is allowed to perform power transmission between a low-speed side rotating member and an output member smoothly, and hence an impact or a noise at the time of switching may be reduced is proposed by the present applicant (Patent Literature 1). Also, in the hoist described above, a device which realizes reduction in size of the load sensitive automatic speed change device is also proposed by the present applicant (Patent Literature 2) (Patent Literature 3).

Patent Literature 1: JP-A-2010-116957
Patent Literature 2: JP-A-2011-106666
Patent Literature 3: JP-A-2012-52572

SUMMARY OF INVENTION

Technical Problem

A hoist with built-in load sensitive automatic speed change device described above includes a low-speed side input rotation member coupled to a hand wheel and having an outer magnetic body configured to transmit a high load, a high-speed side input rotating member coupled to the low-speed side input rotating member via a rotational speed-increasing device and having an inner magnetic body configured to transmit a low load, and an output member configured to be displaced in a direction of an axial line of axes of rotation of the both rotating members by position switching means configured to act according to the magnitude of the outside load, having an intermediate magnetic body configured to magnetically engage one of the magnetic bodies of the low-speed side input rotating member and the high-speed side input rotating member, and configured to perform switching between a low-load high-speed rotation and a high-load low-speed rotation, the low-speed side rotating member includes an engaging portion configured to mechanically engage the output member, the engaging portion is configured to engage the output member after the intermediate magnetic body of the output member faces and magnetically engages the outer magnetic body of the low-speed side input rotating member, and is configured to support the outer periphery of the low-speed side input rotating member coupled to the hand wheel by a bearing provided on an outer peripheral frame, so that a large-diameter bearing has to be used, and hence there is a problem of a high cost.

It is an object of the present invention to provide a hoist with built-in load sensitive automatic speed change device, which is less expensive and has a compact structure in comparison with the hoist by employing a configuration in which the offset amount between a hand wheel and a load chain is small, and a large-diameter bearing is not used.

Solution to Problem

The present invention solves the above-described problem, and provides a hoist with built-in load sensitive automatic speed change device including: a speed-reducing mechanism configured to drive a load sheave axially supported by a frame on one side of the load sheave and a mechanical brake which applies a brake force by a load applied to the load sheave on the other side thereof;

a drive shaft configured to couple the speed-reducing mechanism and the mechanical brake; a hand wheel that rotates the load sheave via the mechanical brake;

a high-torque input member coupled to the hand wheel and configured to transmit a high load; a magnetic clutch coupled to the hand wheel via a speed-increasing mechanism and configured to transmit a low load by a magnetic force of a permanent magnet; and output transmitting means selectively coupled to either one of the high-torque input member or the magnetic clutch in accordance with the magnitude of the load and transmits a rotational operating force of the hand wheel to the mechanical brake, wherein the hand wheel is axially supported by a drive member coupled to the output transmitting means of the mechanical brake, the magnetic clutch is arranged between the speed-increasing mechanism and the hand wheel, the hand wheel and the speed-increasing mechanism are coupled by a hollow input member coupled to the hand wheel and provided so as to cover the outer periphery of the magnetic clutch so as to allow transmission of torque, and the output transmitting means is fitted onto a boss portion of the drive member so as to allow torque transmission to the boss portion.

Also, the invention is also the speed-increasing mechanism characterized in that a planetary gear mechanism, the hollow input member is coupled to a planetary carrier of the planetary gear mechanism, the magnetic clutch is coupled to a sun gear of the planetary gear mechanism, a ring gear of the planetary gear mechanism is fixed to the frame, and a cover frame configured to cover the hand wheel is provided.

Also, the invention is also characterized in that the drive shaft penetrates a center hole provided in the sun gear and is supported at a distal end thereof by a bearing provided on the cover frame.

Advantageous Effects of Invention

The hoist of the present invention is, as described above, configured in such a manner that the hand wheel is axially supported by the drive member coupled to the output transmitting means of the mechanical brake and configured to be rotated thereby, the magnetic clutch is arranged between the speed-increasing mechanism and the hand wheel, the hand wheel and the speed-increasing mechanism are coupled by the hollow input member provided so as to cover the outer periphery of the magnetic clutch so as to allow transmission of torque, and the output transmitting means is fitted onto the boss portion of the drive member so as to allow torque transmission to the boss portion.

Therefore, although the large-diameter bearing is required in the device of the related art since a configuration of supporting the outer periphery of the input rotating member by the bearing provided on the outer peripheral frame is required, the large-diameter bearing is not required in the present invention because the hand wheel and the output transmitting means are supported by the drive member of the mechanical brake, reduction in size is enabled. Also, since the magnetic clutch is surrounded by the hollow input member and the speed-increasing mechanism, entry of dust or the like into the magnetic clutch may be prevented.

Also, by providing the planetary gear mechanism as the speed-increasing mechanism, the thickness of the device is reduced, and since the planetary carrier and the sun gear are rotated about the same center of rotation, the hand wheel can be rotatably supported by the drive member and the planetary carrier of the planetary gear mechanism, so that the hand wheel may be axially supported stably and reduction in size of the device is enabled.

Also, since the planetary gear mechanism, the magnetic clutch, and the hand wheel are axially supported by the drive shaft, bearing is achieved desirably and the configuration of the device may be simplified and reduced in size as a whole, whereby a low cost is achieved and reduction of the offset amount between the hand wheel and the load chain is achieved, so that the hoist in which occurrence of deflection during the operation is prevented may be provided.

DESCRIPTION OF EMBODIMENTS

Figure 1:
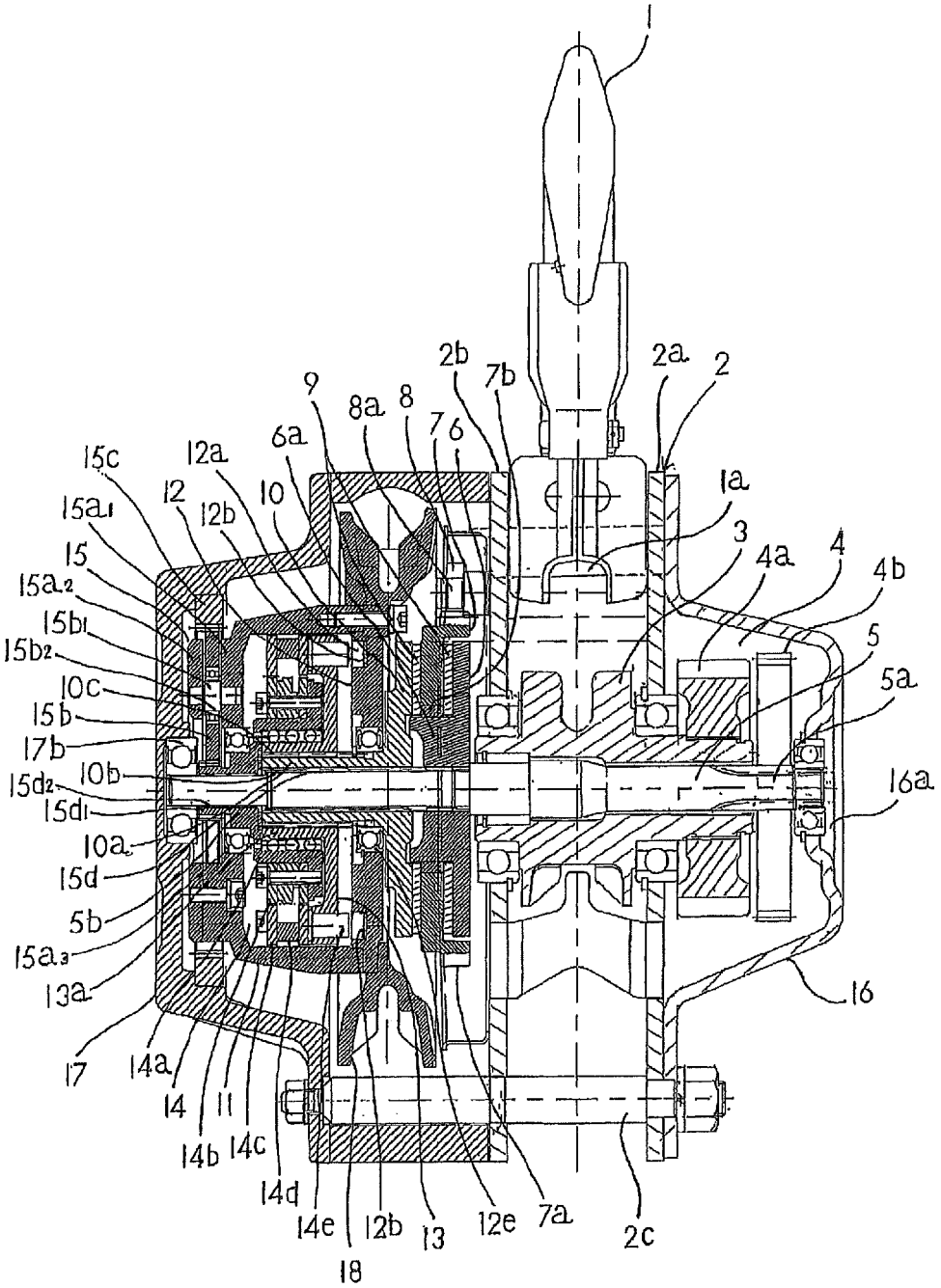
FIG. 1 is a cross-sectional side view of a hoist of the present invention.
Figure 2:
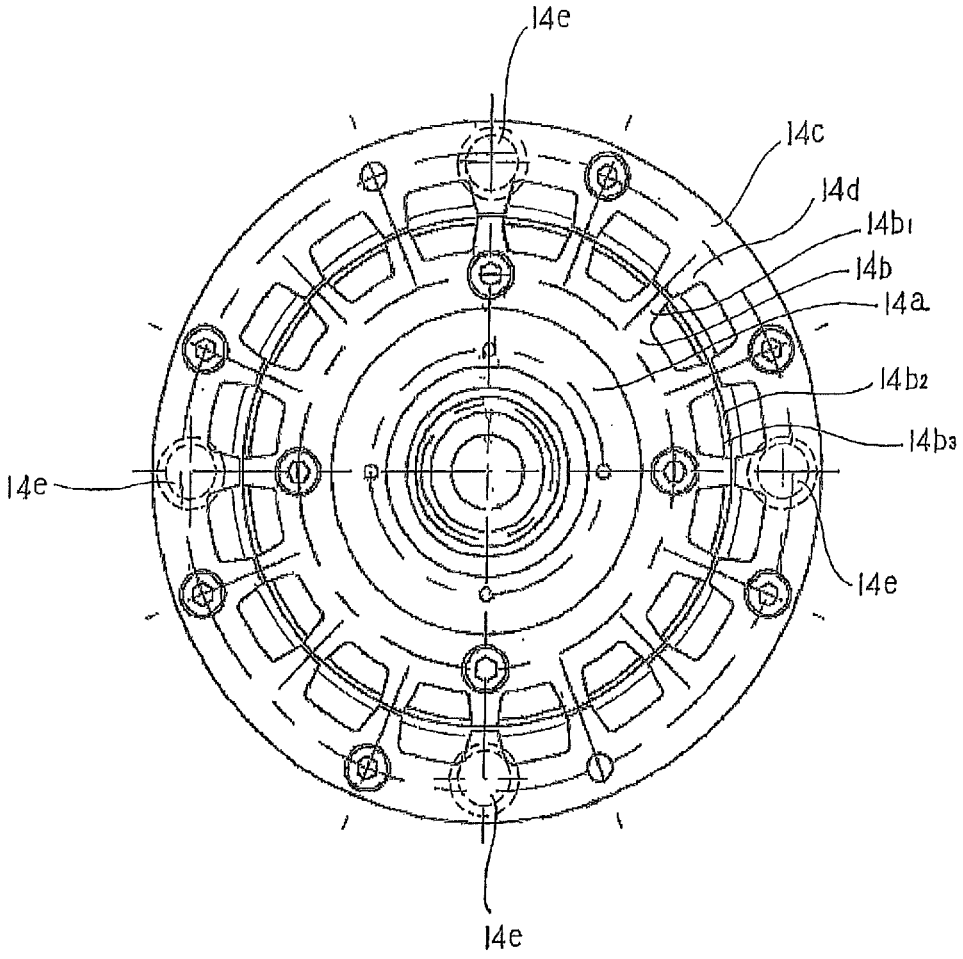
FIG. 2 is an explanatory configuration drawing of a magnetic clutch.
Figure 3:
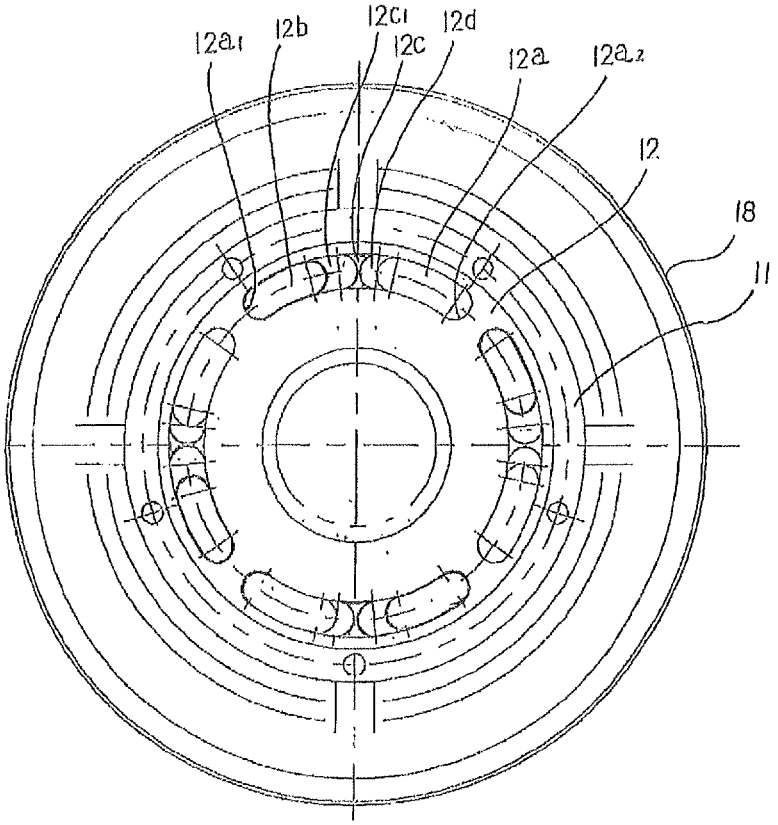
FIG. 3 is an explanatory configuration drawing of a high-torque input member.

Referring now to FIG. 1 to FIG. 8, an embodiment of a load sensitive automatic speed change device of the present invention and a hoist (chain block) with the same therein will be described.

In the drawing, reference sign 1 denotes an upper hook of the hoist, reference sign 1*a* denotes an upper hook mounting shaft configured to secure the upper hook 1 to a body frame 2, reference sign 2 denotes the body frame provided with a load sheave and a speed-reduction gear bearing, reference signs 2*a*, 2*b* denote steel-plate frames of the body frame 2 having a load sheave 3 interposed therebetween, and reference sign 2*c* denotes a coupling shaft configured to couple the steel-plate frames 2*a*, 2*b*, and the body frame 2 includes the steel-plate frames 2*a*, 2*b* and the coupling shaft 2*c*, reference sign 3 denotes the load sheave axially supported between the steel-plate frames 2*a*, 2*b* so as to be rotatable and configured to hoist and lower a load chain, not illustrated, reference sign 4 denotes a speed-reduction gear mechanism, and reference sign 4*a* denotes a load gear spline-coupled to a boss portion of the load sheave 3, reference sign 4*b* denotes a speed-reduction gear (large) engaging a pinion 5*a* of a drive shaft 5 and mounted via a shaft coaxially with a speed-reduction gear (small), not illustrated, engaging the load gear 4*a*, and the rotation of the drive shaft 5 is transmitted to the load sheave 3 with decreased speed. Reference sign 5 denotes the drive shaft inserted into a through hole of the load sheave 3 so as to be rotatable and is provided with the pinion 5*a* at one end and a male screw 5*b* at the other end. The drive shaft 5 is axially supported at a distal end on the side of the pinion 5*a* on a cover frame 16 of the speed-reduction gear mechanism 4 by a bearing 16*a*, and at a distal end on the side of the male screw 5*b* on a cover frame 17 of a hand wheel 18 via a bearing 17*b*.

Reference sign 6 designates a brake pressure receiving member axially mounted on the drive shaft 5 so as not to be rotatable, and a pair of friction discs 9, 9 and a reverse rotation preventing ratchet 7 sandwiched between the friction discs 9, 9 are rotatably fitted on a boss portion 6*a* thereof.

Figure 7:
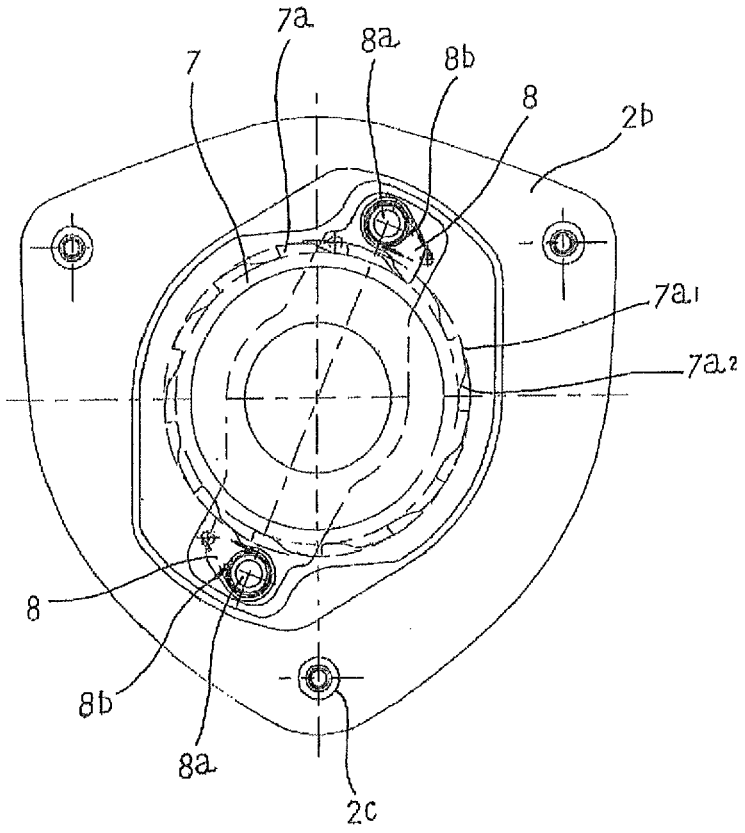
FIG. 7 is an explanatory configuration drawing of a ratchet.
Figure 8:
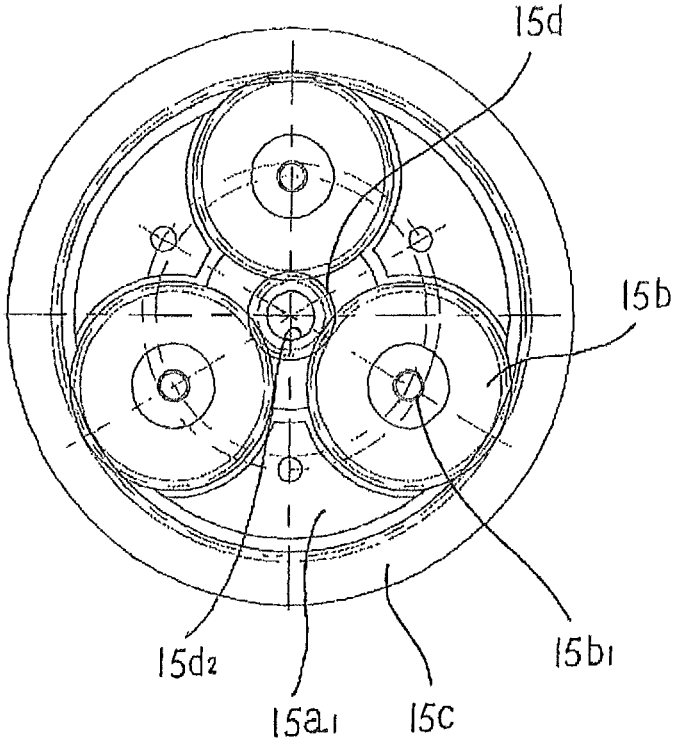
FIG. 8 is an explanatory configuration drawing of a planetary gear mechanism.

Reference sign 7*a* denotes a tooth portion of the reverse rotation preventing ratchet 7, and the tooth portion 7*a* is provided with a first bevel $7a_1$ and a second bevel $7a_2$, described later, as illustrated in FIG. 7. Reference sign 7*b* denotes a slide bearing, reference sign 8 designates a claw, reference sign 8*a* denotes a claw shaft and reference sign 8*b* denotes a spring urging the claw 8 toward the ratchet 7.

The first bevel $7a_1$ provided on the tooth portion 7*a* of the reverse rotation preventing ratchet 7 includes a bevel provided so that the claw 8 abuts against the tooth portion 7*a* about the claw shaft 8*a* at a gentle angle when the rotation of the hand wheel 18 is rotated at a high speed via the planetary gear mechanism 15. The second bevel $7a_2$ is a bevel provided so that the claw 8 rotates about the claw shaft 8*a* to an extent larger than the first bevel $7a_1$ and abuts reliably against the tooth portion 7*a*, and configured to engage the claw 8 deeply to reliably prevent the reverse rotation of the ratchet 7.

In this manner, with the provision of the first bevel $7a_1$ configured to allow the claw 8 to abut gently against the tooth portion 7*a* of the reverse rotation preventing ratchet 7 and the second bevel $7a_2$ configured to allow the same to abut strongly against the tooth portion 7*a*, generation of noises of the claw 8 and the ratchet 7 generated when the ratchet 7 rotates at a high-speed may be prevented and a reverse rotation preventing function may be achieved reliably at a high-torque rotation.

Reference sign 10 denotes a drive member of a mechanical brake, includes a female screw 10*b* on an inner peripheral portion of a boss portion 10*a* and a spline 10*c* on an outer periphery portion thereof, causes the female screw 10*b* to engage the male screw 5*b* of the drive shaft 5 and rotate in the forward direction (hoisting operation) to press the friction discs 9, 9 and the reverse rotation preventing ratchet 7 toward the brake pressure receiving member 6 with a braking surface thereof and transmits the rotation of the drive member 10 to the drive shaft 5, and causes the female screw 10*b* to rotate in a reverse direction (lowering operation) to slide in a direction opposite to the pressing direction to release the frictional engagement with the reverse rotation preventing ratchet 7 and allow the reverse rotation (lowering). The drive member 10 constitutes an input portion of the mechanical brake, which is to be rotated and driven.

The boss portion 10*a* is a hollow shaft-shaped boss portion extending from the drive member 10 in the direction of the side surface of the cover frame 17 of the hand wheel 18, described later, in the direction opposite to the braking surface which presses the friction disc 9, 9, a boss portion 13*a* of an output transmitting member 13, illustrated in FIG. 4(*a*) and described later, is loosely fitted to the spline 10*c* provided on the outer periphery of the boss portion 10*a* so as to be slidable by means of a spline 13$a_1$ provided on the inner periphery of the boss portion 13*a* in the axial direction, and the drive member 10 and the output transmitting member are coupled so as to allow transmission of the torque. Furthermore, a hollow input shaft 14*a* of a magnetic clutch 14, described later, is supported on the outer periphery of the boss portion 13*a* so as to be capable of moving relative to each other to allow the rotation and sliding movement in the direction of the axis of rotation by a bearing 14$a_1$.

Reference sign 11 denotes a non-magnetic hollow shaft-shaped hollow input member secured to the hand wheel 18 and reference sign 12 denotes a high-torque input member coupled to the hollow input member 11 and the hand wheel 18 so as to rotate integrally. A carrier 15$a_1$ of a planetary gear mechanism 15, described later, is integrally coupled to the other side of the hollow input member 11. Also, the hollow input member 11 includes a peripheral wall configured to cover the outer peripheries of the magnetic clutch 14 and the output transmitting member 13. Reference sign 12*a* denotes an engaging depression of a claw clutch provided on the high-torque input member 12, constitutes the claw clutch engaging and disengaging a clutch projection 14*e*, described later, and includes a forward rotation torque transmitting side surface 12$a_1$ configured to engage the clutch projection 14*e* at the time of forward rotation of the high-torque input member 12 illustrated in FIG. 3 and a reverse rotation torque transmitting side surface 12$a_2$ engaging the clutch projection 14*e* at the time of reverse rotation. Reference sign 12*b* denotes a clutch holding magnetic body provided on a bottom surface of a depression of the engaging depression 12*a* and configured to attract the clutch projection 14*e*. The clutch projection 14*e* is formed of a ferromagnetic body excited by a permanent magnet 14*d*, and is configured to be attracted by the clutch holding magnetic body 12*b* when the clutch projection 14*e* moves toward the engaging depression 12*a* of the high-torque input member 12 through a clutch switching action, described later, and is retained by the same. The high-torque input member 12 is formed of a non-magnetic body except for the clutch holding magnetic body so as not attract the clutch projection 14*e*.

Figure 6:
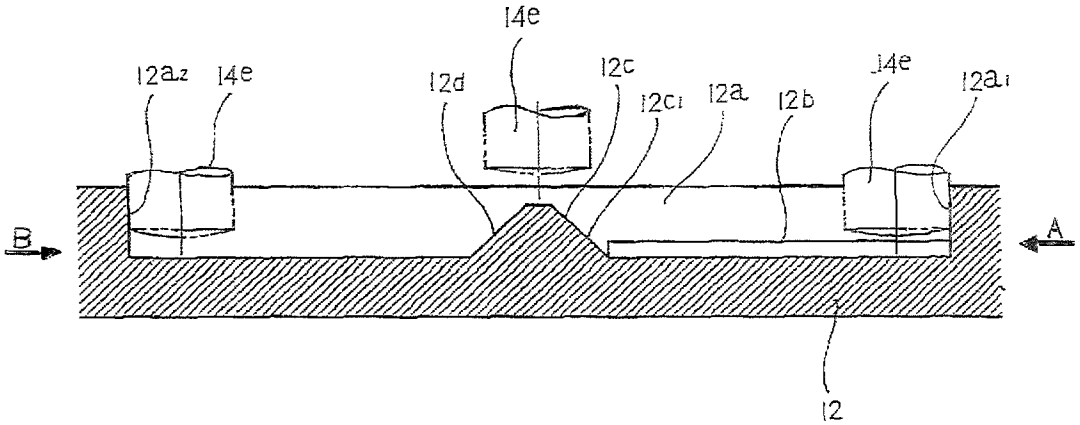
FIG. 6 is an explanatory drawing of a clutch projection and a high-torque input member in the high-torque transmitting state.

Reference sign 12*c* denotes a clutch disengaging projection formed of a non-magnetic body provided on an intermediate portion between the forward rotation torque transmitting side surface 12$a_1$ and the reverse rotation torque transmitting side surface 12$a_2$ of the engaging depression 12*a*, and includes a clutch disengaging bevel 12$c_1$ configured to abut against the clutch projection 14*e* by rotating the hand wheel 18 in the reverse direction to forcedly disengage the clutch projection 14*e* and the clutch holding magnetic body 12*b* at the time of the hoisting operation and a restricting bevel 12*d* configured to restrict the movement of the clutch projection 14*e* so as to prevent the clutch projection 14*e* from being attracted by the clutch holding magnetic body 12*b* at the time of the lowering operation. The clutch disengaging projection 12*c* has a function to move the clutch projection 14*e* relatively from the forward rotation torque transmitting side surface 12$a_1$ toward the reverse rotation torque transmitting side surface 12$a_2$ by rotating the high-torque input member 12 in the reverse direction as illustrated in FIG. 6 so as to allow the clutch projection 14*e* attracted by the clutch holding magnetic body 12*b* on the side of the forward rotation torque transmitting side surface 12$a_1$ to abut against the clutch disengaging bevel 12$c_1$ of the clutch disengaging projection 12*c* during the relative movement to disengage the clutch projection 14*e* from the clutch holding magnetic body 12*b* as illustrated at a center position in FIG. 6. Even when being disengaged from the engaging depression 12*a* once, when a load torque reaches a predetermined value or higher, the clutch projection 14*e* is slid to the interior of the engaging depression 12*a* again, abuts against the forward rotation torque transmitting side surface 12$a_1$ or the reverse rotation torque transmitting side surface 12$a_2$ depending on the direction of rotating the hand wheel 18, and transmits a rotational torque.

Reference sign 15 denotes the planetary gear mechanism acting as a speed-increasing mechanism, reference sign 15$a_1$ denotes the planetary carrier coupled to the hollow input member 11, reference sign 15$a_2$ is a planetary carrier constituting a pair with the planetary carrier 15$a_1$, reference sign 15*b* denotes a planetary gear axially supported by the planetary carriers 15$a_1$, 15$a_2$ so as to be rotatable, reference sign 15$b_1$ designates a planetary gear shaft implanted in the planetary carriers 15$a_1$, 15$a_2$, reference sign 15*c* denotes a ring gear which allows inscribing engagement of the planetary gear 15*b*, reference sign 15*d* designates a sun gear provided on a sun gear shaft 15$d_1$, reference sign 15$d_1$ denotes the sun gear shaft as an output shaft of the speed-increasing mechanism. The planetary gear 15*b* comes into a circumscribing engagement with the sun gear 15*d* and comes into inscribing engagement with the ring gear 15*c*, increases the rotation of the planetary carrier 15$a_1$, and rotates the sun gear shaft 15$d_1$ at an increased speed.

The planetary gear mechanism 15 including the planetary carrier 15$a_1$ to the sun gear 15*d* is arranged between the side surfaces of the boss portion 10*a* of the drive member 10 and the cover flame 17 as illustrated in FIG. 1. A center hole 15$d_2$ which allows insertion of the drive shaft 5 is provided at centers of the sun gear 15*d* and the sun gear shaft 15$d_1$.

Reference sign 14 designates the magnetic clutch, including the hollow input shaft 14*a* coupled to the sun gear shaft 15$d_1$ so as to allow transmission of the rotational power and an inner yoke 14*b* provided on the outer periphery of the hollow input shaft 14*a* and formed of a soft magnetic body, is provided with the permanent magnet 14*d* and an outer yoke 14*c* excited by the permanent magnet 14*d* on the outer periphery of the inner yoke 14*b*, so that the torque transmittable by a magnetic attracting force acting therebetween is transmitted between the inner yoke 14*b* and the outer yoke 14*c*. The hollow input shaft 14*a* has a length substantially the same as that of the boss portion 13*a* of the output transmitting member 13, is arranged so as to be overlapped with the outer periphery of the boss portion 13*a* in the direction of the axis of rotation, and is axially supported by the bearing 14$a_1$ so as to be rotatable and axially slidable with respect to the boss portion 13*a*.

The outer yoke 14*c* is secured to the output transmitting member 13 together with the permanent magnet 14*d*, the spline 13$a_1$ is provided on the inner periphery of the boss portion 13*a* of the output transmitting member, the spline 13$a_1$ is coupled to the spline 10*c* on the outer periphery of the boss portion 10*a* of the drive member 10 so as to be slidable in the axial direction, and the outer yoke 14*c* is coupled to the outer periphery of the hollow shaft-shaped boss portion 10*a* of the drive member 10 so as to be incapable of rotating relatively to the drive member 10.

In order to enhance the torque transmittable between the outer yoke 14*c* and the inner yoke 14*b* by the magnetic force, the permanent magnet 14*d* has a doughnut disc shape and is polarized into an N-pole on one side surface and into an S-pole on the other side surface, and the permanent magnet 14*d* is held between a pair of outer yokes 14*c*, 14*c*, a pair of inner yokes 14*b*, 14*b* are arranged on the inner periphery of the pair of outer yokes 14*c*, 14*c* so as to face each other and, in addition, tooth-shaped portions $\mathbf{14}c_1$, $\mathbf{14}b_1$ having a plurality of tooth tips arranged are provided on inner and outer peripheral surfaces of the outer yoke 14*c* and the inner yoke 14*b* facing each other so that the tooth tips thereof face each other.

Reference sign $\mathbf{14}b_2$ denotes a doughnut disc-shaped side magnetic body fitted on the hollow input 14*a* of the magnetic clutch 14 on the side surface of the tooth-shaped portion $\mathbf{14}b_1$, and reference sign $\mathbf{14}b_3$ denotes a small-diameter portion of the side magnetic body.

Reference sign 14*e* is the clutch projection constituting the claw clutch which is formed a ferromagnetic body. The clutch projection 14*e* is provided so as to project from the output transmitting member 13 toward the high-torque input member 12, engages the engaging depression 12*a* provided on the high-torque input member 12 at the time of the high-load rotation, and is attracted by the clutch holding magnetic body 12*b* provided on the engaging depression 12*a*.

The magnetic clutch 14 is fitted on the outer periphery of the boss portion 10*a* of the drive member 10 in a space surrounded by the hollow portion of the hollow input member 11, the carrier $\mathbf{15}a_1$ of the planetary gear mechanism 15 provided on one side of the hollow input member 11, and the high-torque input member 12 provided on the other side as illustrated in FIG. 1.

Reference sign 18 denotes the hand wheel as rotation torque input means, and is secured to the hollow input member 11 and the high-torque input member 12 with coupling means. Also, the hand wheel 18 is axially supported on the boss portion 10*a* of the drive member 10 together with the high-torque input member 12 via a bearing 12*e* so as to be rotatable, and is axially supported on the outer periphery of the sun gear shaft $\mathbf{15}d_1$ by a bearing $\mathbf{15}a_3$ via the hollow input member 11 and the planetary carrier $\mathbf{15}a_1$ so as to be rotatable. The sun gear shaft $\mathbf{15}d_1$ is secured on the hollow input shaft 14*a* supported on the outer periphery of the hollow-shaft shaped boss portion 13*a* of the output transmitting member 13 by the wide bearing $\mathbf{14}a_1$ so as to extend in the axial direction. The boss portion 13*a* of the output transmitting member 13 of the magnetic clutch 14 is slidably fitted to the hollow-shaft shaped boss portion 10*a* of the drive member 10 via the splines 10*c*, $\mathbf{13}a_1$. The drive member 10 is screwed to the drive shaft 5 with the male screw 5*b* and the female screw 10*b* via the boss portion 10*a*, and the drive shaft 5 is supported by the cover frames 16, 17 secured to the frame 2 respectively by the bearings 16*a*, 17*b* at the distal ends thereof. Therefore, the hand wheel 18, the magnetic clutch 14, and the output transmitting member 13 are supported on the drive shaft 5 via the respective bearing portions described above, and rotate concentrically with the drive shaft 5.

Subsequently, a switching action of the magnetic clutch mechanism of the present invention will be described.

Figure 4:
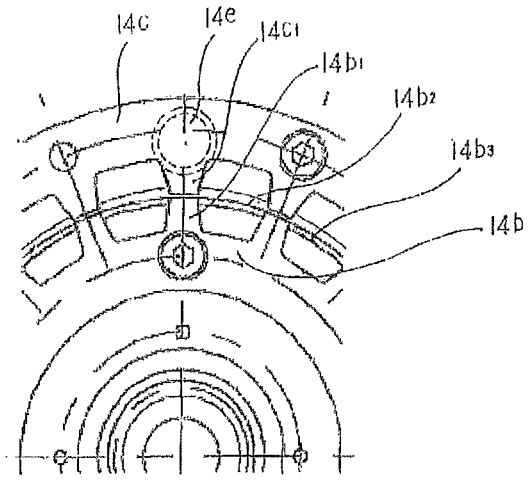
FIG. 4(*a*) is a cross-sectional side view illustrating a low-torque transmitting state, and FIG. 4(*b*) is an explanatory configuration drawing of FIG. 4(*a*).
Figure 4:
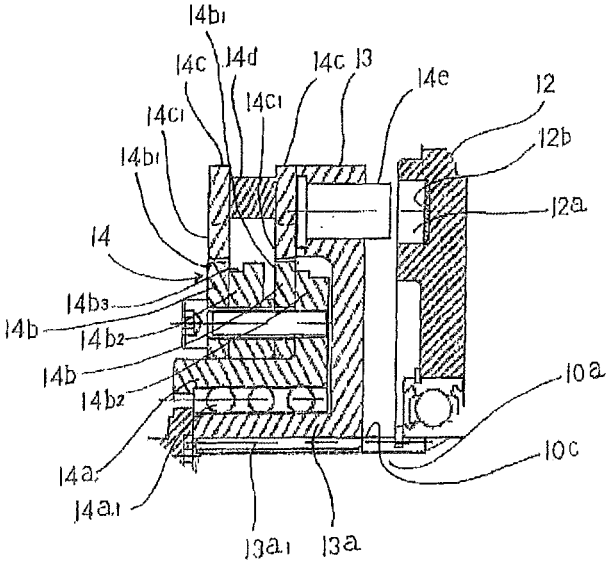

At the time of low-load rotation in which there is no load to be hung or the load to be hung is light and hence the load required to rotate the hand wheel 18 is small, as illustrated in FIGS. 4(*a*) and (*b*), the tooth-shaped portion $\mathbf{14}b_1$ of the inner yoke 14*b* and the tooth-shaped portion $\mathbf{14}c_1$ of the outer yoke 14*c* secured to the output transmitting member 13 are in a state of facing each other, so that the tooth-shaped portion $\mathbf{14}c_1$ of the outer yoke 14*c* excited by the permanent magnet 14*d* and the tooth-shaped portion $\mathbf{14}b_1$ provided on the inner yoke 14*b* form a magnetic circuit via gaps between tooth tips of the tooth-shaped portion of the both, and a strong magnetic attracting force is generated between the both rotating means.

In this state, a component force of an attracting force caused by a magnetic force between the tooth-shaped portion $\mathbf{14}c_1$ of the outer yoke 14*c* and the tooth-shaped portion $\mathbf{14}b_1$ of the inner yoke 14*b* in the direction of center line of rotation is in balance with that in the direction of center line of rotation of the attracting force caused by the magnetic force between the outer yoke 14*c* and the side magnetic body $\mathbf{14}b_2$, and the tooth-shaped portion $\mathbf{14}b_1$ of the inner yoke 14*b* and the tooth-shaped portion $\mathbf{14}c_1$ of the outer yoke 14*c* maintain the state illustrated in FIGS. 4(*a*) and (*b*), transmit the torque from the tooth-shaped portion $\mathbf{14}b_1$ of the inner yoke 14*b* to the tooth-shaped portion $\mathbf{14}c_1$ of the outer yoke 14*c*, and rotate the outer yoke 14*c* at the same speed as the sun gear shaft $\mathbf{15}d_1$ increased in speed at a predetermined speed increasing ratio.

Figure 5:
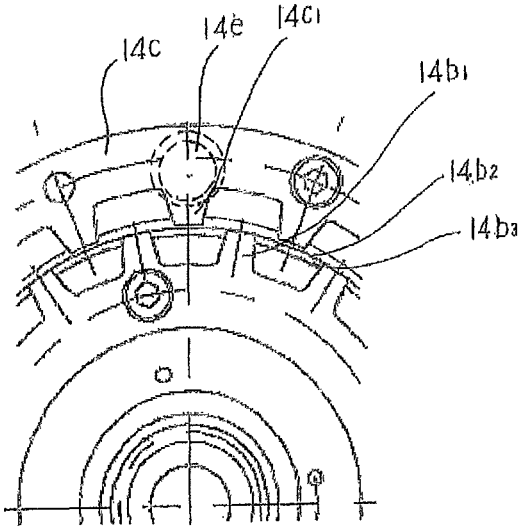
FIG. 5(*a*) is a cross-sectional side view illustrating a high-torque transmitting state, and FIG. 5(*b*) is an explanatory configuration drawing of FIG. 5(*a*).
Figure 5:
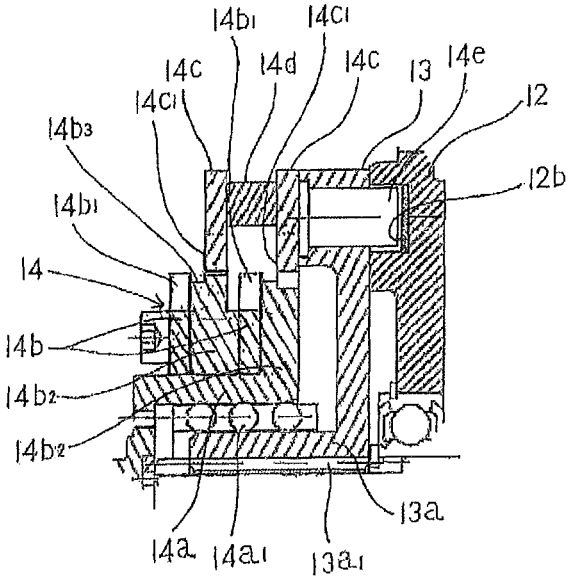

Subsequently, when the load torque is increased by hoisting a heavy load and hence the load torque exceeds the magnetic attracting force between the tooth-shaped portion $\mathbf{14}b_1$ of the inner yoke 14*b* and the tooth-shaped portion $\mathbf{14}c_1$ of the outer yoke 14*c*, the inner yoke 14*b* and the outer yoke 14*c* rotate relative to each other, and the magnetic circuit formed between the tooth tips of the tooth-shaped portion of the tooth-shaped portion $\mathbf{14}c_1$ of the outer yoke 14*c* and the tooth-shaped portion $\mathbf{14}b_1$ of the inner yoke 14*b* is displaced to the magnetic circuit flowing through the side magnetic body $\mathbf{14}b_2$, so that the component force of the attracting force in the direction of center line of rotation caused by the magnetic force between the tooth-shaped portion $\mathbf{14}c_1$ of the outer yoke 14*c* and the tooth-shaped portion $\mathbf{14}b_1$ of the inner yoke 14*b* is reduced. In contrast, a component force of the attracting force caused by the magnetic force between the outer yoke 14*c* and the side magnetic body $\mathbf{14}b_2$ in the direction of center line of rotation is increased. When the component force of the attracting force caused by the magnetic force between the outer yoke 14*c* and the side magnetic body $\mathbf{14}b_2$ in the direction of center line of rotation is increased to a level larger than the component force of the attracting force caused by the magnetic force between the tooth-shaped portion $\mathbf{14}c_1$ of the outer yoke 14*c* and the tooth-shaped portion $\mathbf{14}b_1$ of the inner yoke 14*b* in the direction of center line of rotation, the outer yoke 14*c* slides in the direction of the center line of rotation, the relative position between the tooth-shaped portion $\mathbf{14}c_1$ of the outer yoke 14*c* and the tooth-shaped portion $\mathbf{14}b_1$ of the inner yoke 14*b* is displaced, whereby the magnetic circuit is formed between the tooth-shaped portion $\mathbf{14}c_1$ of the outer yoke 14*c* and the side magnetic body $\mathbf{14}b_2$ as illustrated in FIGS. 5(*a*) and (*b*) and, simultaneously, the clutch projection 14*e* sliding together with the outer yoke 14*c* engages the engaging depression 12*a* of the high-torque input member 12 rotating at the same speed as the hand wheel 18 and is attracted by the clutch holding magnetic body 12*b*, so that the mode is switched to a high-load transmission mode.

Subsequently, when the load is lowered to a level lower than the predetermined value after having uncharged, the tooth-shaped portion $\mathbf{14}c_1$ of the outer yoke 14*c* and the tooth-shaped portion 14$b_1$ of the inner yoke 14*b* face each other by the magnetic force and the magnetic circuit formed between the outer yoke 14*c* and the side magnetic body 14$b_2$ is switched to the magnetic circuit flowing through the tooth-shaped portion 14$b_1$ of the inner yoke 14*b*, so that the component force of the attracting force caused by the magnetic force between the tooth-shaped portion 14$c_1$ of the outer yoke 14*c* and the tooth-shaped portion 14$b_1$ of the inner yoke 14*b* in the direction of center line of rotation is increased and the component force of the attracting force caused by the magnetic force between the outer yoke 14*c* and the side magnetic body 14$b_2$ in the direction of center line of rotation is reduced, whereby the component force of the attracting force caused by the magnetic force between the tooth-shaped portion 14$c_1$ of the outer yoke 14*c* and the tooth-shaped portion 14$b_1$ of the inner yoke 14*b* in the direction of center line of rotation exceeds the component force of the attracting force caused by the magnetic force between the outer yoke 14*c* and the side magnetic body 14$b_2$ in the direction of center line of rotation. Therefore, a returning thrust force is generated, and the tooth-shaped portion 14$c_1$ of the outer yoke 14*c* is slid to a position facing the tooth-shaped portion 14$b_1$ of the inner yoke 14*b*, so that the low-load transmission mode is achieved.

When the hoisting operation of the hand wheel 18 is stopped in a state of having a load hung therefrom in a hoist provided with the mechanical brake operated by the load, the load applied by the load hung therefrom is held by the reverse rotation preventing ratchet 7 of the mechanical brake, and hence the load applied between the inner yoke 14*b* and the outer yoke 14*c* disappears. When the engagement of the claw clutch is released in the same manner as a low-load state after having uncharged in the state described above, a switching action from the low-load state (low-load transmission mode) to a high-load state (high-load transmission mode) by the magnetic clutch 14 and the claw clutch is executed every time when the hoisting operation of the hand wheel 18 is started. However, in this embodiment, when the mode is switched to the high-load transmission mode by the hoisting action, the clutch holding magnetic body 12*b* attracts the clutch projection 14*e* to prevent the claw clutch from returning, so that the occurrence of a shock caused by the switching action described above is prevented.

When the lowering operation (the operation to rotate the hand wheel 18 in the reverse direction) after having hoisted the load, as illustrated in FIG. 6, the clutch projection 14*e* moves away from the forward rotation torque transmitting side surface 12$a_1$ of the high-torque input member 12 beyond the clutch disengaging bevel 12$c_1$ provided on the clutch disengaging projection 12*c* toward the reverse rotation torque transmitting side surface 12$a_2$ side and abut against the same, transmits a high-load torque in the reverse direction, and lowers the load.

Since the clutch holding magnetic body 12*b* is not arranged between the reverse rotation torque transmitting side surface 12$a_2$ and the clutch disengaging projection 12*c*, the claw clutch and the magnetic clutch return to the low-load transmission mode automatically when the no-load state is achieved by being uncharged, and the load is lowered at a high speed so that the hoisting is allowed.

When the clutch projection 14*e* is attracted by the clutch holding magnetic body 12*b* at the time of low-load rotation in which there is no load to be hung or the load to be hung is light and hence the load required to rotate the hand wheel 18 is light, by rotating the hand wheel 18 in the reverse direction to rotate the high-torque input member 12 in the reverse direction, so that the clutch projection 14*e* is moved from the forward rotation torque transmitting side surface 12$a_1$ of the engaging depression 12*a* provided on the high-torque input member 12 to the reverse rotation torque transmitting side surface 12$a_2$ side as illustrated in FIG. 6 and, during this moving action, the clutch projection 14*e* abuts against the clutch disengaging bevel 12$c_1$ of the clutch disengaging projection 12*c* and is guided by the bevel to be disengaged from the clutch holding magnetic body 12*b*, while the outer yoke 14*c* slides to a position facing the tooth-shaped portion 14$b_1$ of the inner yoke 14*b* and is switched to the low-load transmission mode.

According to this embodiment, since the switching of the claw clutch provided on the output transmitting member 13 secured on the outer yoke 14*c* and the claw clutch provided on the high-torque input member 12 is conducted by sliding the outer yoke 14*c* using the thrust force generated by the relative rotation between the tooth-shaped portion 14$c_1$ of the outer yoke 14*c* and the tooth-shaped portion 14$b_1$ provided on the inner yoke 14*b* by the load applied to the magnetic clutch 14, a thrust conversion mechanism provided separately, which is an device required in the device of the related art is not necessary to be provided, so that the number of components is reduced, the structure is simplified, reduction in size and weight is enabled, the manufacturing cost is significantly reduced. Also, at the time of high load, since the clutch projection 14*e* provided on the outer yoke 14*c* is configured as the claw clutch engaging the high-torque input member 12 by the thrust force generated by the relative rotation of the outer yoke 14*c* and the inner yoke 14*b*, the power transmission may be performed accurately even at the time of high load, and also the switching of the clutch may be performed at a high response.

In addition, since the clutch holding magnetic body 12*b* is provided on the engaging depression 12*a* of the high-torque input member 12, the clutch projection 14*e* is attracted by the clutch holding magnetic body 12*b* when the output transmitting member 13 switches from the inner yoke 14*b* to the high-torque input member 12, a switching action may be performed quickly and reliably by the clutch projection 14*e*. Also, since the clutch projection 14*e* is attracted constantly by the clutch holding magnetic body 12*b* at the time of the hoisting operation in the high-load transmission mode, occurrence of the clutch return may be prevented.

In addition, since the clutch disengaging projection 12*c* is provided at the intermediate portion between the forward rotation torque transmitting side surface 12$a_1$ and the reverse rotation torque transmitting side surface 12$a_2$ of the engaging depression 12*a*, the clutch projection 14*e* is moved from the forward rotation torque transmitting side surface 12$a_1$ to the reverse rotation torque transmitting side surface 12$a_2$ side by rotating the high-torque input member 12 in the reverse direction at the time of action of the output rotating means 13 switching from the high-torque input member 12 to the inner yoke 14*b* of the magnetic clutch 14 and, during this moving action, the clutch projection 14*e* abuts against the clutch disengaging bevel 12$c_1$ to cause the clutch projection 14*e* to be disengaged from the clutch holding magnetic body 12*b*, so that the output rotating means 13 may be switched from the high-torque input member 12 to the inner yoke 14*b* of the magnetic clutch 14, which is the low-torque input means, and may be switched to the low-load transmitting mode smoothly.

Also, according to the present invention, the hand wheel 18 is axially supported by the drive member 10 coupled to the output transmitting means 6 of the mechanical brake and rotated thereby, the magnetic clutch 14 is arranged between the speed-increasing mechanism 15 and the hand wheel 18, the hollow input member 11 configured to couple the hand wheel 18 and the speed-increasing mechanism 15 so as to allow torque transmission and so as to cover the outer periphery of the magnetic clutch 14 is provided, and the output transmitting means 6 is fitted onto the boss portion 10*a* of the drive member 10 so as to allow torque transmission to the boss portion.

Therefore, although the large-diameter bearing is required in the device of the related art since a configuration of supporting the outer periphery of the input rotating member by the bearing provided on the outer peripheral frame is required, the large-diameter bearing is not required in the present invention because the hand wheel 18 and the output transmitting member 13 are supported by the drive member 10 of the mechanical brake, reduction in size is enabled. Also, since the magnetic clutch 14 is surrounded by the inner peripheral wall of the hollow input member 11 formed of a non-magnetic member and the speed-increasing mechanism, entry of dust or the like into the magnetic clutch may be prevented.

Also, by providing the planetary gear mechanism 15 as the speed-increasing mechanism, the thickness of the device is reduced, and since the planetary carrier 15*a* and the sun gear 15*d* are rotated about the same center of rotation, the hand wheel 18 can be rotatably supported by the drive member 10 and the planetary carrier 15*a* of the planetary gear mechanism, so that the hand wheel 18 may be axially supported stably and reduction in size of the device is enabled.

Also, since the planetary gear mechanism 15, the magnetic clutch 14, and the hand wheel 18 are axially supported by the drive shaft 5, bearing is achieved desirably and the configuration of the device may be simplified and reduced in size as a whole, whereby a low cost is achieved and reduction of the offset amount between the hand wheel and the load chain is achieved, so that a hoist in which occurrence of deflection during the operation is prevented may be provided.

REFERENCE SIGNS LIST

3 load sheave
4 speed-reduction gear mechanism
5 drive shaft
5*a* pinion
5*b* multi-thread male screw
6 brake pressure receiving member
6*a* boss portion
7 ratchet
7*a* tooth portion
7$a_1$ first bevel
7$a_2$ second bevel
8 claw
8*a* claw shaft
9 friction disc
10 drive member
10*a* boss portion
10*b* multi-thread female screw
10*c* spline
11 hollow input member
12 high-torque input member
12*a* engaging depression
12*b* clutch holding magnetic body
12*c* clutch disengaging projection
12*e* bearing
13 output transmitting member
13*a* boss portion of output transmitting member
13$a_1$ spline
14 magnetic clutch
14*a* hollow input shaft
14*b* inner yoke
14$b_1$ tooth-shaped portion
14$b_2$ side magnetic body
14$b_3$ small-diameter portion
14*c* outer yoke
14$c_1$ tooth-shaped portion
14*d* permanent magnet
14*e* clutch projection
15 planetary gear mechanism
15$a_1$ carrier 1
15$a_2$ carrier 2
15$b_2$ bearing
15*c* ring gear
15*d* sun gear
15$d_1$ sun gear shaft
16 cover frame
16*a* drive shaft bearing
17 cover frame
17*b* drive shaft bearing
18 hand wheel

The invention claimed is:

1. A hoist with built-in load sensitive automatic speed change device comprising:

a speed-reducing mechanism configured to drive a load sheave axially supported by a frame, the speed-reducing mechanism being arranged on one side of the load sheave;

a mechanical brake applying a brake force by a load applied to the load sheave, the mechanical brake being arranged on the other side of the load sheave;

a drive shaft configured to couple the speed-reducing mechanism and the mechanical brake;

a hand wheel whose rotation in a hoisting direction rotates the mechanical brake in the hoisting direction, thereby rotating the load sheave in the hoisting direction;

a high-torque input member coupled to the hand wheel and configured to transmit a high load;

a magnetic clutch coupled to the hand wheel via a speed-increasing mechanism and configured to transmit a low load by a magnetic force of a permanent magnet; and output transmitting means selectively coupled to either one of the high-torque input member or the magnetic clutch in accordance with the magnitude of the load and transmitting a rotational operating force of the hand wheel to the mechanical brake, wherein all of the speed-reducing mechanism, the mechanical brake, the load sheave, the hand wheel, the high-torque input member, the magnetic clutch, and the output transmitting means are disposed on the drive shaft, the hand wheel is axially supported by a drive member coupled to the output transmitting means of the mechanical brake and configured to be rotated thereby, the magnetic clutch is arranged between the speed-increasing mechanism and the hand wheel, the hand wheel and the speed-increasing mechanism are coupled by a hollow input member coupled to the hand wheel and provided so as to cover the outer periphery of the entire magnetic clutch so as to allow transmission of torque, and the output transmitting means is fitted onto a boss portion of the drive member so as to allow torque transmission to the boss portion.

2. The hoist according to claim 1, wherein the speed-increasing mechanism is a planetary gear mechanism, the hollow input member is coupled to a planetary carrier of the planetary gear mechanism, the magnetic clutch is coupled to a sun gear of the planetary gear mechanism, a ring gear of the planetary gear mechanism is fixed to the frame, and a cover frame configured to cover the hand wheel is provided.

3. The hoist according to claim 2, wherein the drive shaft penetrates a center hole provided in the sun gear and is supported at a distal end thereof by a bearing provided on the cover frame.

* * * * *